US005466061A

United States Patent [19]

Lautenschläger

[11] Patent Number: 5,466,061

[45] Date of Patent: Nov. 14, 1995

[54] CORNER CONNECTING HARDWARE FOR DRAWERS

[75] Inventor: Horst Lautenschläger, Reinheim, Germany

[73] Assignee: MEPLA-Werke Lautenschläger GmbH & Co. KG, Germany

[21] Appl. No.: 303,454

[22] Filed: Sep. 9, 1994

[30] Foreign Application Priority Data

Sep. 11, 1993 [DE] Germany ..... 43 30 919.4

[51] Int. Cl.[6] ..... A47B 88/00

[52] U.S. Cl. ..... 312/348.2; 312/348.4; 312/184

[58] Field of Search ..... 312/348.1, 348.2, 312/184, 193

[56] References Cited

U.S. PATENT DOCUMENTS

| | | | |
|---|---|---|---|
| 3,687,512 | 8/1972 | Alston | 312/348.2 |
| 3,853,227 | 12/1974 | Filipowski | 312/184 X |
| 3,901,572 | 8/1975 | Litchfield | 312/348.2 |
| 4,099,815 | 7/1978 | Cox et al. | 312/348.2 |
| 4,108,520 | 8/1978 | Litchfield | 312/348.2 |
| 4,128,284 | 12/1978 | King | 312/348.2 |
| 4,277,121 | 7/1981 | Possati et al. | 312/348.4 |
| 4,303,289 | 12/1981 | Hardy | 312/348.2 |
| 4,887,873 | 12/1989 | Goedken et al. | 312/184 |
| 5,221,134 | 6/1993 | Grass | 312/348.2 |

FOREIGN PATENT DOCUMENTS

| | | | |
|---|---|---|---|
| 1175092 | 9/1984 | Canada | 312/348.1 |
| 3611480 | 10/1986 | Germany . | |
| 8912349 | 1/1990 | Germany . | |
| 4026407 | 2/1992 | Germany . | |
| 9201801 | 5/1992 | Germany . | |
| 4200581 | 7/1993 | Germany . | |
| 3704218 | 7/1993 | Germany . | |
| 480207 | 11/1970 | U.S.S.R. . | |
| 1522598 | 8/1978 | United Kingdom | 312/348.2 |
| 2206034 | 12/1988 | United Kingdom | 312/348.1 |

*Primary Examiner*—José V. Chen
*Assistant Examiner*—Rodney B. White

[57] ABSTRACT

Corner connecting hardware for joining the cabinet-interior ends of the drawer sides (14) to their associated back (16) of drawers (10), in the form of a corner piece (30) made of plastic or metal, having structure for attachment to the drawer sides and extending substantially above the height of the drawer walls (14; 16), which can be fastened in the back end area of the drawer side and the associated end area of the drawer back. The corner piece (30) is made at least partially hollow, and a tenon (42) provided at the bottom end of a rail support (40) can be inserted through its upper end which is normally closed off by a top cover (36). In the upper end area of the rail support (40) the ends of rails (20; 22) can be fastened at a distance from and parallel to the drawer side and drawer back (14; 16), respectively, and their other ends can be fastened, one to the drawer front in the one case, and in the other case to the rail support (40) provided at the other end area of the drawer back.

15 Claims, 6 Drawing Sheets

CORNER CONNECTING HARDWARE FOR DRAWERS

Figure 1:
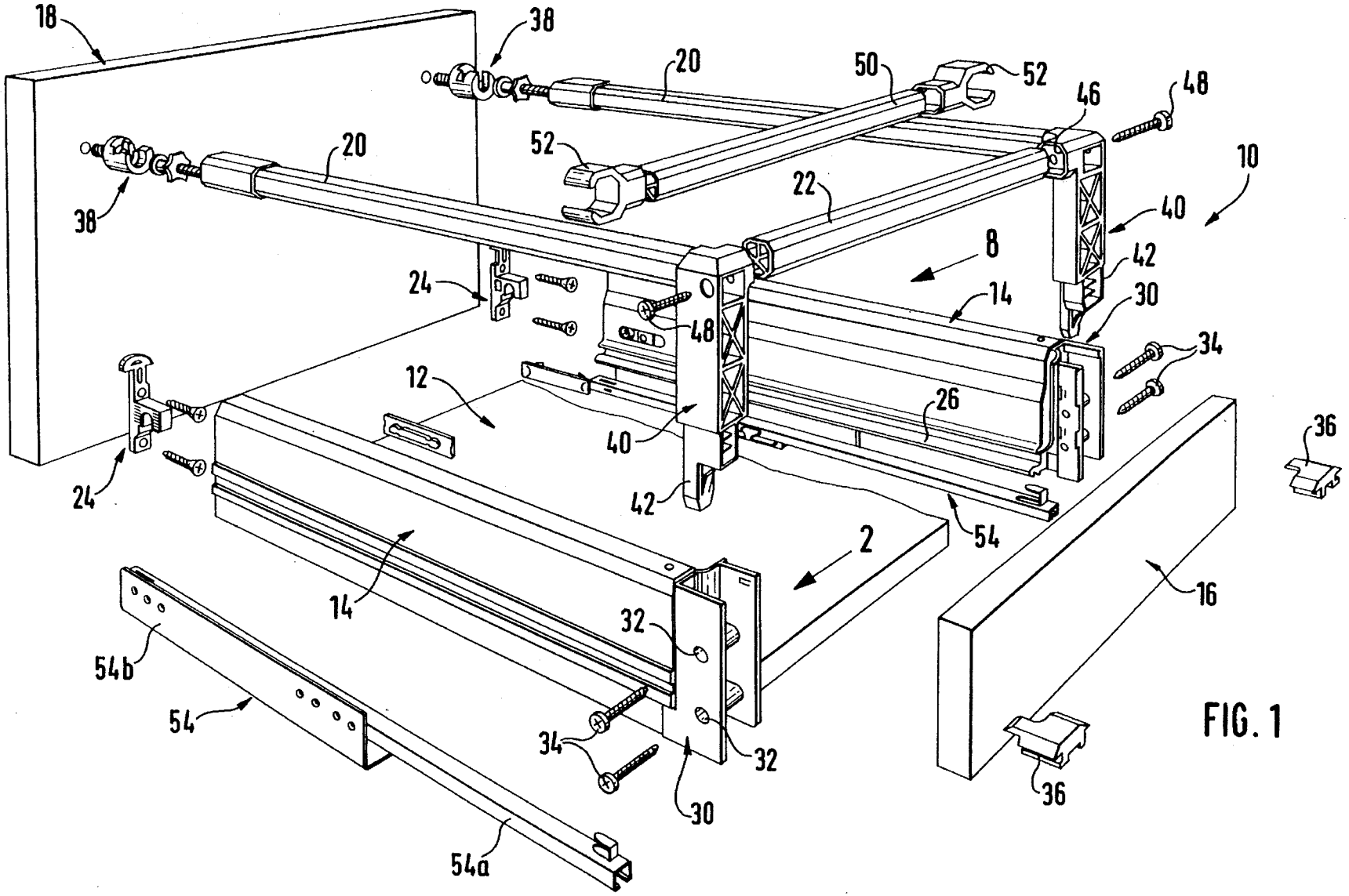

The invention relates to a corner-connecting means for connecting the inside ends of drawer sides with their associated drawer backs, in the form of a corner piece made by injection molding from plastic or pressure casting from metal and extending substantially above the height of the drawer walls, which can be fastened to the back end of the drawer side and to the associated end of the drawer back.

The depth of drawers in chests of drawers depends, among other things, on the contents to be held in the drawer. In addition to normally deep drawers for smaller or shallower objects, drawers are made for higher objects, in which frequently only the drawer front and back are made appropriately high, while the drawer sides are of the same height as in normal drawers. In these cases at least one rail fastened at one end to the drawer front and at the other end to the drawer back is provided to stabilize the drawer as a whole.

Since drawer fronts today are often fastened releasably and for adjustment vertically and/or horizontally to the actual door body by means of appropriate connecting hardware (DE-OS 40 26 407), the replacement of the front of a normal drawer with a front of greater height is easily possible. However, the replacement of the back of a normal drawer with a higher back is more difficult, even though corner pieces, made separately of plastic, for example, are being increasingly used (DE-OS 37 04 218; DE-GM 89 12 349) to serve as connecting pieces in the back end of the particular drawer side and in the associated end of the drawer back. Especially when the connecting part of the corner pieces is adapted in a special manner to the shape and height of the associated drawer walls, it is not easily possible to install a drawer back of greater height instead of one of normal height and thus make it possible to create a deeper drawer with rails to be mounted above the drawer sides.

The invention is addressed to the task of providing a corner connecting means for joining the inside ends of the drawer sides to the associated back of drawers of normal height, in the form of a suitable corner piece which permits the conversion of the drawer of normal depth to a drawer of greater depth with rails provided laterally above the drawer sides, without requiring any adaptation at the drawer back or even the use of a modified corner piece to connect the drawer side of normal height to a higher back.

Setting out from a corner connecting piece of the kind mentioned above, this task is accomplished according to the invention in that the corner piece is made at least partially hollow, and that a tenon provided on the lower end of a rail support can be inserted through the upper end of the corner piece, which is normally closed, into the interior of the corner piece, and that ends of rails can be fastened in the upper ends of the rail supports parallel to and at a distance from the drawer side and drawer back. The corner piece provided for drawers of normal wall height thus permits a rail support to be placed on it, to which both the rails to be provided at a distance above the drawer sides and an additional rail to be provided at a distance above the normal-height drawer back can be attached. The need for replacement of the drawer back by a higher one is thus completely eliminated, so that the conversion of a normal drawer to a drawer for holding higher goods requires only the replacement, relatively easily made as stated above, of the drawer front with one of greater height.

Preferably the corner piece is fastened to the back end surface of the drawer side and the associated end surface of the drawer back.

The closure of the corner piece can be a separately made cap which can be inserted into the upper end of the corner piece, and removed in order to insert the tenon of the rail support.

Alternatively, the closure at the top of the corner piece can be made so as to be able to be pierced or snapped off along a line around the area of the closure. In the conversion of a normally deep drawer to a deeper one, the central portion of the closure can be pierced by the tenon of the rail support or by means of a separate tool, and then the tenon can be inserted into the hollow corner piece.

The corner piece, in a preferred embodiment of the invention, is in the basic form of a thin-walled molding that is largely closed on the side facing the back end surface of the drawer side and at the associated end surface of the drawer back, and at a parallel distance from the end face of the drawer back, flush with the outside surface of the drawer side, and then - in the case of a separately inserted cap - it is configured at the top cover and at least one of the upper margins of its walls parallel to the drawer back, as a guide permitting the horizontal insertion of the cap from the open back of the molding.

At the rear side facing away from the drawer front, the molding forming the corner piece is open, however, which has advantages in production over a likewise possible embodiment with a closed back.

In one of the walls of the corner molding parallel to the drawer back it is expedient to provide a catch means securing the cap in the proper inserted state against extraction, the catch means being formed by an indentation in one and a projection in the other of the parts to be snapped together.

The tenon of the rail support is best guided for longitudinal displacement in the interior of the corner piece, in which case it is recommendable to provide in the free end of the tenon, and in the part of the corner piece which surrounds this free end when the tenon is in the proper inserted position, a catch means securing the rail support against withdrawal from the corner piece.

The catch means can be, for example, a resilient tongue provided on the tenon or inside of the corner piece, and a catching edge in the corner piece or tenon, as the case may be, to catch the bottom or back of the tongue in the intended inserted position.

In a preferred embodiment of the invention, the tongue is in the front end of the tenon and extends backward against the direction of insertion and leans outward, so that, when the tenon is properly inserted, the back end of the tongue protrudes outside of the surface of the tenon, but can be forced resiliently back into the tenon, while its free end is directly underneath the catching edge formed inside of the corner piece.

In order to offer also an aesthetically pleasing appearance in the back area of a drawer converted in the manner of the invention to a drawer of greater depth, the external shape of the part of the rail support that extends above the corner piece and is visible when it is in the properly inserted position is conformed to the corner piece at least in its area directly adjoining the latter, and the dimensions of the tenon are smaller than the visible part of the rail support. The rail support installed on the corner piece then appears as a unit, i.e., does not appear to be an added-on part.

The rail support is advantageously given a cross section other than circular, at least on a portion of it, and then in the hollow interior of the corner piece at least one guiding surface is provided adjoining the noncircular portion of the tenon when it is in the proper inserted state. This assures that when the tenon is inserted into the corner piece the rail support can be installed only in the correct position.

If the top end of the corner piece is closed off by an integral section which can be pierced or broken open along a scored line, it is expedient to define the cross section of the tenon, at its transition to the part of the rail support that is visible when it is correctly installed, to match the contour of the scored line defining the area that can be pierced or broken open.

In that case it may be desirable if the thickness reduction of the top end linearly defining the section which can be pierced or broken open is so made that along a part of the linear scoring an articular junction, in the form of a film hinge, for example, is formed, which thus will still join the pierced top section to the corner piece such that this area will only be turned into the hollow interior of the corner piece. When a drawer of greater depth, equipped with railing, is converted to a drawer of normal depth, it will then be possible to turn back up the part of the top end that was turned into the interior of the corner body and fasten it in an appropriate manner so that the opening will again be closed.

Figure 2:
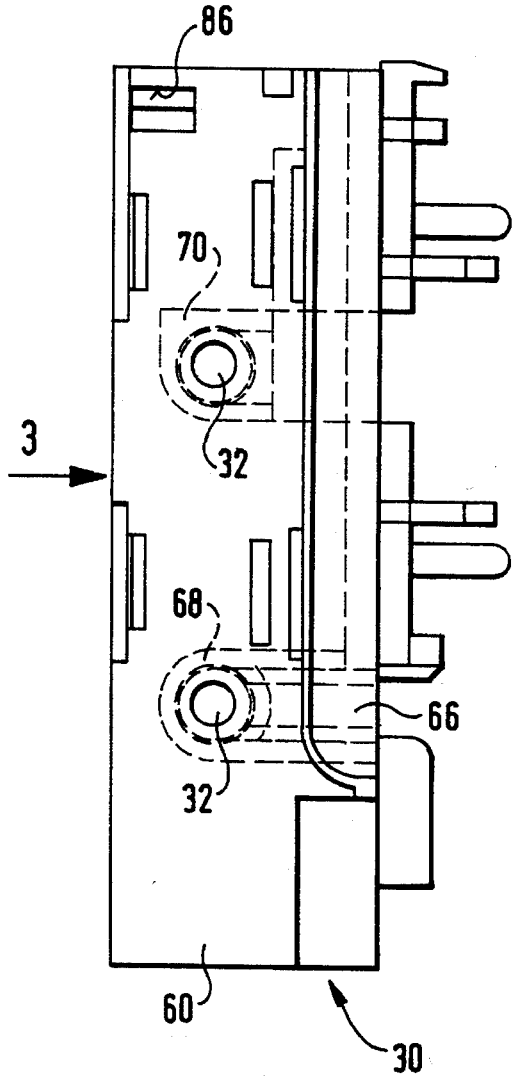
Figure 3:
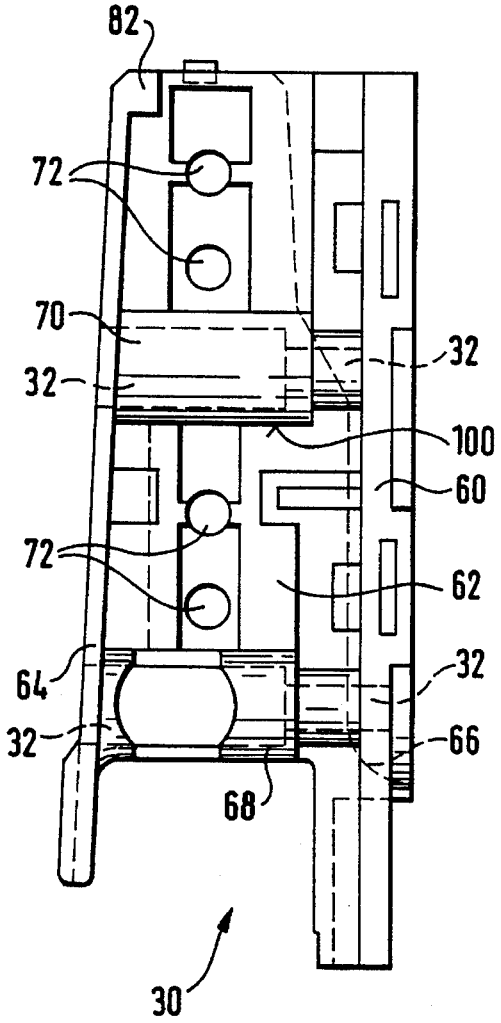
Figure 4:
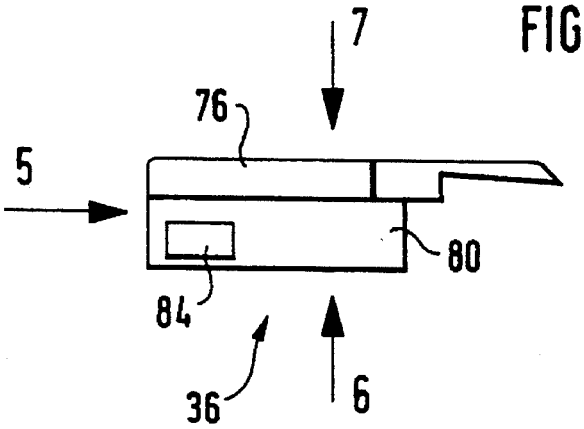
Figure 5:
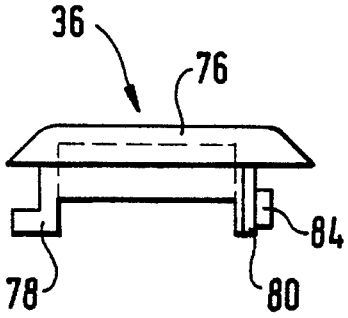
Figure 6:
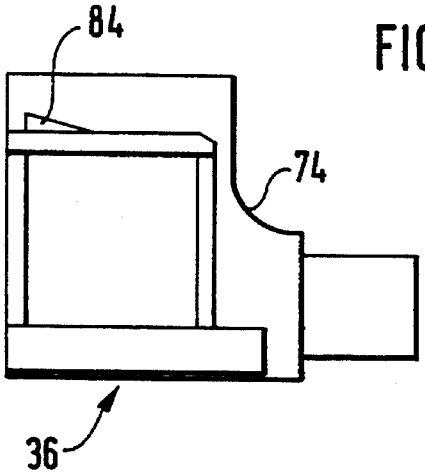
Figure 7:
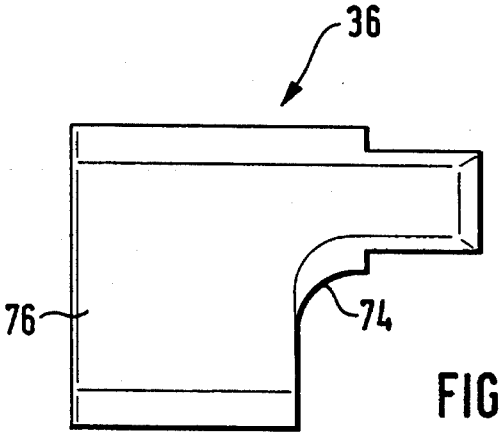
Figure 8:
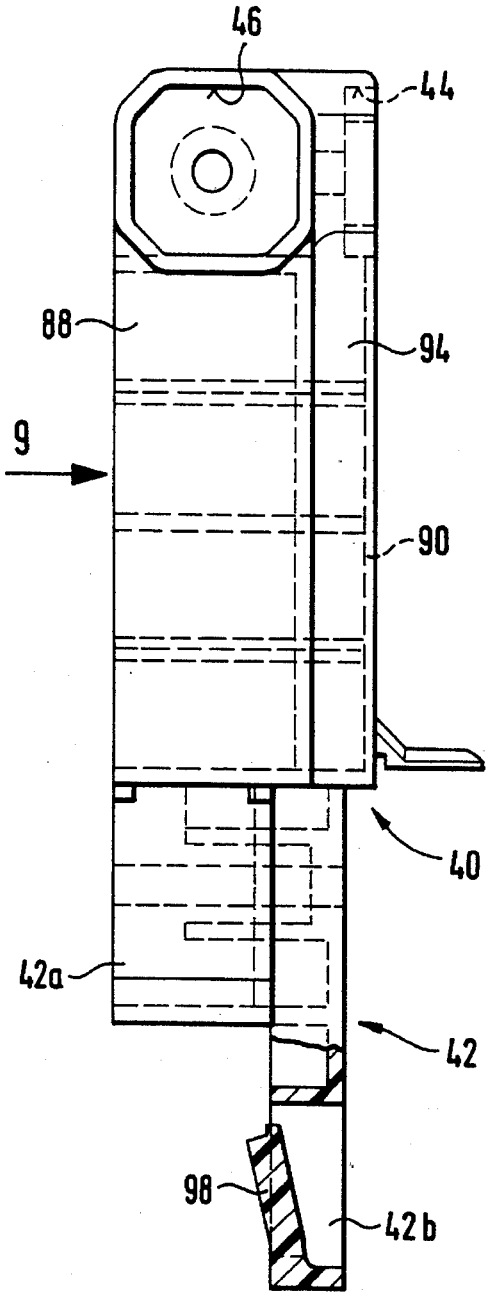
Figure 9:
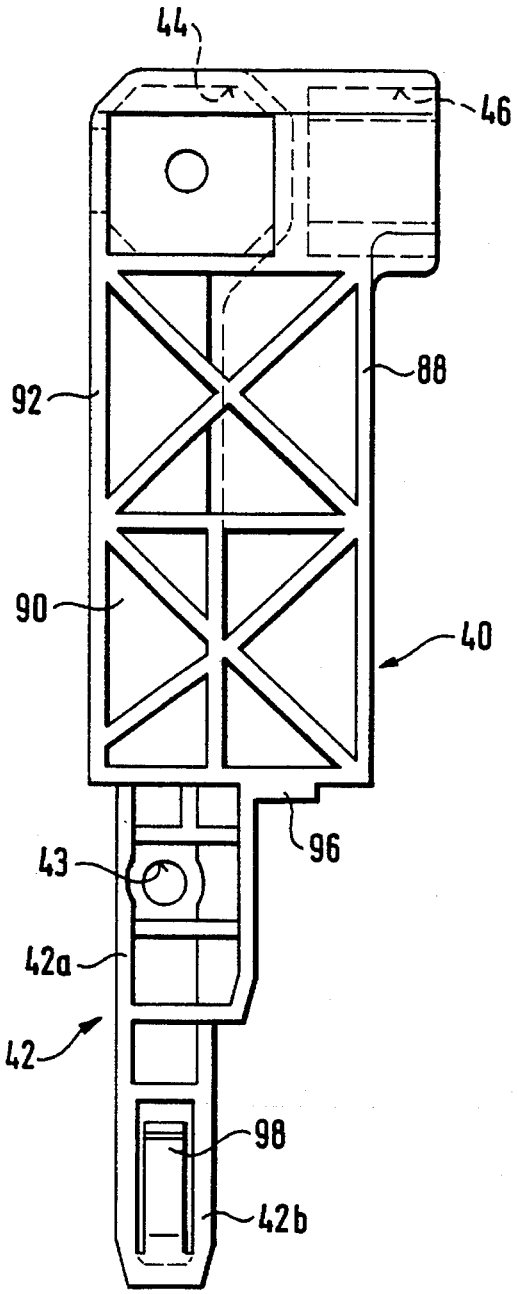
Figure 10:
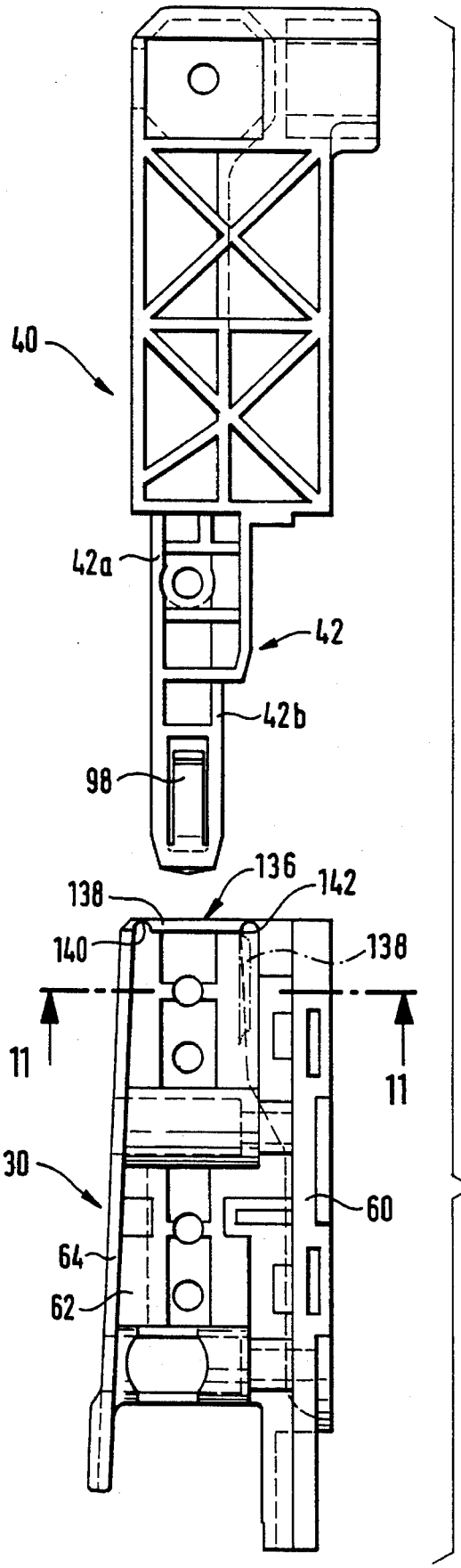
Figure 11:
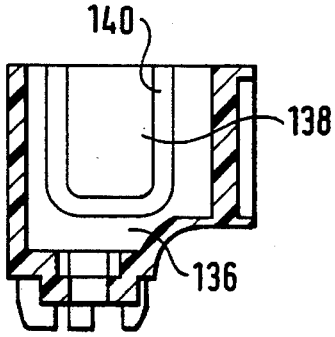
Figure 12:
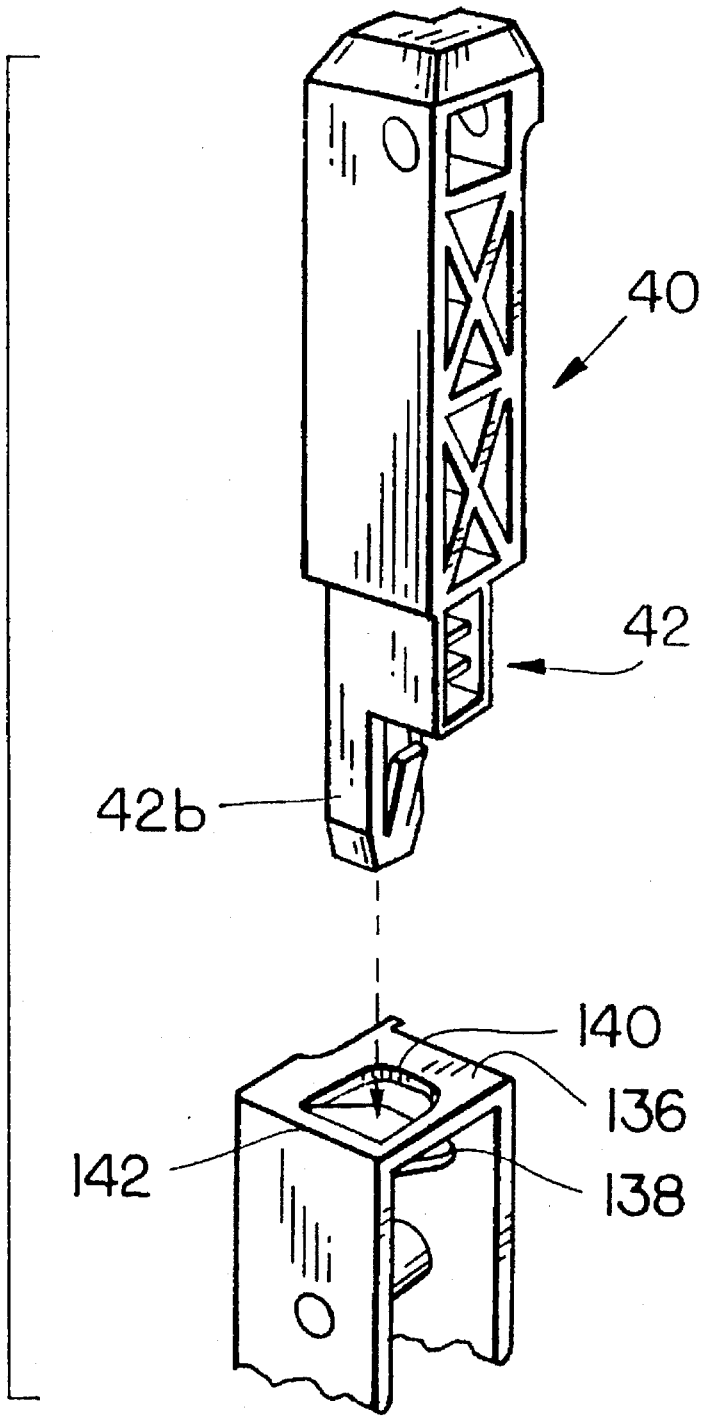

The invention will be further explained in the description that follows of two embodiments, in conjunction with the drawing, wherein:

FIG. 1 is an exploded perspective schematic view of a drawer of a size to accommodate comparatively tall objects, with corner pieces configured in the manner of the invention joining together the drawer sides to the drawer back, and rail supports to be placed on the corner pieces to hold rails;

FIG. 2 a side view of a first embodiment of one of the corner pieces as seen in the direction of arrow 2 in FIG. 1;

FIG. 3 a rear view of the corner piece, in the direction of arrow 3 in FIG. 2;

FIG. 4 a side view of a cap which can be inserted into the open top of the corner piece of FIGS. 2 and 3;

FIG. 5 a rear view of the cap seen in the direction of arrow 5 in FIG. 4;

FIG. 6 a bottom view of the cap seen in the direction indicated by the arrow 6 of FIG. 4;

FIG. 7 a plan view of the cap seen in the direction of arrow 7 in FIG. 4;

FIG. 8 a side view of the rail support which can be placed on the corner piece in accordance with FIGS. 2 and 3;

FIG. 9 a rear view of the rail support in the direction of arrow 8 in FIG. 1;

FIG. 10 a schematic rear view seen in the same direction as in FIGS. 3 and 9, of a corner piece differing from the corner piece shown in FIGS. 2 and 3, and of the rail support which can be fastened thereon, in the separated, i.e., still unassembled state, and FIG. 11 a sectional view through the corner piece, seen in the direction of the arrow 11—11 of FIG. 10;

FIG. 12 is an exploded perspective view of the embodiment of FIG. 11.

The drawer shown in an exploded view and designated as a whole by 10 has, in the conventional manner, a drawer bottom 12, two side pieces 14, in this case being in the form of double-walled metal sides, a drawer back 16 and front 18 of greater height than the height of the sides 14 and back 16, rails 20 spaced above and aligned with the sides, and a rail 22 running at right angles to rail 20 and aligned with the drawer back 16.

The drawer front 18 is fastened to the front ends of the drawer sides 14 by means of known hardware 24 permitting, as a rule, a horizontal and/or vertical alignment of the drawer front 18 relative to the sides 14, while the drawer bottom 12 is fastened to it by a pair of elongated flanged sections of the drawer sides holding it at the bottom and perhaps also on the top, or, as in the case shown, by so-called harpoon strips 26, i.e. ribs of saw-tooth like cross section projecting from the drawer side 14 and forced into a groove in the margin of the drawer bottom 12 facing the drawer side.

The drawer back 16 is joined to the drawer sides 14, in the manner described hereinafter in connection with FIGS. 2 and 3, by corner pieces 30 configured in accordance with the invention and serving as fastening means, which in the case shown are formed by channel-like, open-backed bodies injection molded from plastic and provided with means for joining them to the vertical end face of the drawer back 16, namely bores 32 through which screws 34 can be driven into the end face of the drawer back 16. Projections fitting into the hollow interior of the drawer side 14 hold the corner piece 30 in alignment with the associated drawer sides 14, and then, by means not shown in the drawing, they are fastened to the drawer sides. This junction can also be made, for example, by driving screws from the open back of the corner piece 30 into fastening bodies or projections provided in the ends of the hollow drawer sides.

At the open upper end the corner pieces 30 can be closed by caps 36 (FIGS. 4 to 7) which can be snapped into the desired closing position from the open back. These caps 36 close off the top of the associated corner piece as long as drawers of normal depth are involved, in which therefore no rails have to be installed above the drawer sides 14 or back 16.

The rails 20 are screwed at their front end to the inside of the drawer front by means of fastening devices 38, known in themselves. At their back end they are fastened each to a rail support 40 (FIGS. 8 and 9), the same as the ends of the rail 22.

The rail supports 40 can be fastened in the corner pieces 30 by inserting the tenons 42 into the open tops (after removing the cover 36) of the corner pieces 30, the portion of the rail supports adjoining the tenons being shaped so that they will be flush with the corner pieces and thus give the impression that the corner piece 30 and the rail support 40 fastened to it are integral.

The rails 20 and 22 enter into sockets 44 and 46, respectively, of matching cross-sectional shape and are fastened to the corresponding rail support 40 by screws driven into the end face of the rails, of which only the screws 48 joining the rail 22 to rail support 40 are shown.

In FIG. 1 there is additionally shown a possibility for providing a rail 50 in the area between the rail 22 and the drawer front 18, running parallel to rail 22; clips 52 which can be snapped onto rails 20 are provided on the extremities of rail 50 for that purpose. Lastly, the drawer guides 54 are shown in FIG. 1, which hold the drawer 10 so that it can be moved as a whole in and out of a cabinet carcase, and which are composed of runner rails **54*a* to be attached to the bottom of the drawer sides 14 and the guide rails 54*b*** to be fastened to the associated carcase side wall.

The corner piece 30 shown in FIGS. 2 and 3 is injection molded from plastic and consists essentially of three walls running at right angles to one another, i.e., vertical walls 60, 62 and 64 forming an approximately channel shape in which walls 60 and 62 are of a special shape to match the shape of the end faces of drawer back 16 and drawer side 14 to which they are to be joined, and also lugs and projections to strengthen areas in which bores are provided for the screws. Such special shaping of the corner piece walls are not relevant to the invention and therefore are not further described. It is only to be pointed out that the area of transition 66 from the wall 62 to be joined to the corresponding drawer side to the wall 60 is not a sharp corner but a corner of round cross section. The outer wall 64 opposite wall 60 is, however, substantially flat and is pierced only by the two vertically offset bores 32 which extend through horizontal portions 68 and 70 inside of the corner piece and through the opposite wall 60 and serve to accommodate the screws 34.

A plurality—four in the case shown—of bores 72 are provided for screws or the like for anchoring the corner pieces 30 in their associated drawer side 14. At their open top end the corner pieces 30 are closed by a cap 36, a cap 36 of this kind being shown in FIGS. 4 to 7. In its external outline (FIGS. 6 and 7) the cap is defined to match the shape of the meeting walls 60, 62, 64; the rounded section 74 corresponding to the rounded transition 66 is visible in FIGS. 6 and 7. From the bottom of the flat top 76 two strips 78 and 80 project, which can be inserted between the walls 60 and 64. Strip 78 is provided with a groove facing the wall, which is engaged by a projection 82 protruding from the inside of wall 64 at the upper end. From the strip 80 a ramp-like projection 84 extends, which is associated with an opening 86 in wall 60 serving as a catch. The cap 36 can thus be inserted into the corner piece 30 from the open back and snapped in the intended end position, although it can be removed in case of necessity if first the walls 60 and 64 are spread apart sufficiently for the projection 84 to come free of the opening 86.

Such withdrawal of the cap 36 is necessary when the rail support 40 shown in detail in FIGS. 8 and 9 is to be inserted into the corner piece 30. The rail support 40, provided at its upper end with the previously mentioned sockets 44 and 46 for the attachment of rails 20 and 22, is also injection molded from plastic and, in the area that is visible when installed on the corner piece, it has three vertical walls 88, 90 and 92 continuing into the walls 60, 62, 64 of the corner piece, while the open-backed chamber formed between the walls is reinforced by webs running diagonally and horizontally. The hollow formed by the transition 66 of the corner body also continues in the transition 94 of the walls 88 and 90.

The tenon 42, integrally injection molded at the bottom end of the walls 88, 90 and 92 closed off by a wall 96, and has the shape that can be seen in FIGS. 8 and 9 and, when the cap 36 is removed, it can be inserted downwardly into the corner piece 30, while the larger upper tenon section 42a provides for guidance between the walls 60, 62 and 64, while the downwardly projecting narrower tenon section 42b has a tongue 98 protruding at an angle from this tenon section and snaps outwardly behind an edge 100 formed on the bottom of the horizontal portion 70 through which the upper bore 32 passes. The horizontal portion 70 is therefore provided in its area facing the wall 62 of the corner piece 30 with an opening, not shown in FIGS. 2 and 3, through which the tenon section 42b can be snugly fitted. At the same time the tongue 98 is first pressed back into the interior of the tenon section 42b, until it is in the engaging position and then snaps against the edge 100, anchoring the rail support 40 in corner piece 30 against accidental withdrawal. To remove the rail support 14 the tongue 98 must be pressed back, from the open back of the corner piece, until it comes free of the edge 100, and then the rail support 40 can be removed by drawing it upward.

In FIG. 9 it can be seen that, in the upper section 42a of the tenon 42 a bore 43 is provided which lines up with the uppermost of the four bores 72 in the corner piece in the installed position. By means of a pin or shaft introduced into the aligned bores 43 and 72, for example the threaded shaft of a screw (not shown) threaded into the associated drawer side 14, the rail support 40 can additionally be secured against withdrawal from the corner piece 30. The above-described possibility for the additional fixation of the rail support 40 in the corner piece 30 can alternatively be achieved by means of aligned bores in the walls of the tenon 42 and corner piece 30 facing the back 16 of the drawer, and then a screw, for example, is driven through the bores in the drawer back.

In FIGS. 10 and 11 there is shown a second embodiment of the invention, in which the rail support is identical with the described rail support 40, so there is no need to describe it again. The corner piece 30 is also largely the same as the previously described corner piece according to FIGS. 2 and 3, differing only in that, instead of the cap 36 which can be inserted between walls 60, 62 and 64 at the top, here it is topped by a cover 136 injection molded integrally with it. This top cover 136 is formed with central area 138 which is defined in a bottom view (FIG. 11) by a score 140 in the top cover 136 which central area 138 matches the cross section of the tenon 42. Pressing down strongly or striking the tenon section **42*b* against the area 138 breaks the central area 138 inwardly along the score 140 the configuration can also be made such that a portion of the score 140 will not break when the tenon 42 is pressed against it, but will act as a film hinge 142. Then the area 138 will fold into the interior of the corner piece 30 in the manner shown in broken lines in FIG. 10**.

I claim:

1. Corner-connecting hardware kit for a drawer for connecting an inside end of a drawer side with an associated end of a drawer back, in the form of a corner-connecting assembly extending above the height of the drawer back and drawer side and oriented parallel to said ends thereof, the drawer having a side rail parallel to and spaced above the side wall, the side being fastened to a drawer front, the drawer further having a back rail parallel to and spaced above the drawer back, the kit comprising (1) a corner piece having means for fastening the corner piece to the inside end of the drawer side and to the associated end of the drawer back, the corner piece having an interior that is at least partially hollow, and (2) an elongated rail support having a tenon extending longitudinally from a bottom end of the rail support, the tenon being insertable into the interior of the corner piece through an upper end of the corner piece to thereby form a corner-connecting assembly comprising the corner piece and the rail support, the rail support having at a top end thereof means for receiving and retaining in perpendicular orientation thereto the side rail and the back rail

2. The kit according to claim 1, further comprising (3) a cap insertable into the upper end of the corner piece to cover the upper end.

3. The kit according to claim 2, wherein the cap has top side having a basic thickness, wherein the top side has a region of reduced thickness as compared to the basic thickness, said region of reduced thickness comprising at least a line of reduced thickness, whereby a portion of the top side of the cap defined by the region of reduced thickness is penetrable by the tenon so as to cause said portion to break away along the line of reduced thickness to thereby allow the introduction of the tenon therethrough and into the interior of the corner piece.

4. The kit according to claim 3, wherein the portion of the top side of the cap defined by the region of reduced thickness is shaped to conform to a widest external perimeter of the tenon.

5. The kit according to claim 4, wherein the portion of the top side of the cap defined by the region of reduced thickness has adjacent thereto a portion of non-reduced thickness forming a hinge portion, which hinge portion remains attached to a remaining portion Of the top side of the cap after penetration by the tenon.

6. The kit according to claims 3, wherein the portion of the top side of the cap defined by the region of reduced thickness has adjacent thereto a portion of non-reduced thickness forming a hinge portion, which hinge portion remains attached to a remaining portion of the top side of the cap after penetration by the tenon.

7. The kit according to claim 2, wherein the corner piece has three longitudinal sides, a first side facing against the inside end of the drawer side, a second side facing against the associated end face of the drawer back, and a third side parallel to and spaced apart from the second side, so that in an assembled position, an outer face of the third side is in flush prolongation with an outer face of the drawer side, and wherein the cap and an upper portion of at least one of the second and third sides of the corner piece each have coacting guide means which permits the insertion of the cap in a direction perpendicular to a longitudinal axis of the corner piece by way of an at least partially open back, fourth side of the corner piece.

8. The kit according to claim 7, wherein the guide means comprises a catch means for securing the cap in a proper inserted position against withdrawal from the corner piece, the catch means comprising a catch recess in one of the cap and the at least one side of the corner piece, and a catch projection on the other of the cap and the at least one side of the corner piece.

9. The kit according to claim 1, wherein the tenon of the rail support fits entirely within the interior of the corner piece.

10. The kit according to claim 1, further comprising a catch means for securing the rail support against withdrawal from the corner piece, the catch means comprising a first element thereof located near a free end of the tenon leading in a direction of insertion into the interior of the corner piece, and a second element located within the interior of the corner piece at a location adjacent the first element of the free end when the tenon is in a fully inserted position.

11. The kit according to claim 10, wherein the catch means comprises a resilient tongue as one of the first element and second element, and a catch edge on which the tongue catches when in the fully inserted position as the other of the first element and the second element.

12. The kit according to claim 11, wherein the tongue is attached in the front end portion of tenon and extends backward contrary to the insertion direction and leans outwardly, so that its back end projects beyond the outer boundary of the tenon yet can be resiliently pressed back into the tenon, and its free end face is immediately below the catch edge formed in the interior of the corner piece.

13. The kit according to claim 1, wherein at least one pair of associated bores for receiving a fastening means is provided, one of said pair of associated bores being located in the tenon of the rail support and the other of said pair of associated bores being located in the corner piece, such that the bores are aligned with one another when the tenon is in the fully inserted position.

14. The kit according to claim 1, wherein an external perimeter of a lower portion of the rail support from which the tenon extends conforms to an external perimeter of an upper portion of the corner piece and wherein an external perimeter of the tenon has reduced dimensions in comparison to the lower portion of the rail support.

15. The kit according to claim 1, wherein the tenon has a noncircular cross sectional portion, and wherein in the hollow interior of the corner piece there is provided at least one guiding surface which, in a proper inserted position of the tenon within the hollow interior, is in contact with the noncircular cross sectional portion of the tenon.

* * * * *